United States Patent [19]

Kauffeldt et al.

[11] Patent Number: 5,022,114

[45] Date of Patent: Jun. 11, 1991

[54] DEVICE FOR SUCTIONING UP AND REMOVING A CONTAMINATED LIQUID

[76] Inventors: Horst Kauffeldt, Bachstr. 150; Thomas Kauffeldt, Kyffhauser Str. 27, both of, 4000 Dusseldorf, Fed. Rep. of Germany

[21] Appl. No.: 320,013

[22] Filed: Mar. 7, 1989

[30] Foreign Application Priority Data

Mar. 11, 1988 [DE] Fed. Rep. of Germany ..... 3808124

[51] Int. Cl.[5] ..... A47L 5/38

[52] U.S. Cl. ..... 15/353; 15/321; 137/205; 4/664

[58] Field of Search ..... 15/302, 314, 321, 353; 137/205; 4/661, 664, 665

[56] References Cited

U.S. PATENT DOCUMENTS

| | | | |
|---|---|---|---|
| 2,497,435 | 2/1950 | Brannem | 15/314 |
| 4,641,392 | 2/1987 | Huisma | 15/314 X |
| 4,691,407 | 9/1987 | Sloan et al. | 15/339 |
| 4,766,637 | 8/1988 | Winnicki | 15/339 |
| 4,823,428 | 4/1989 | Sevigny | 15/353 |

FOREIGN PATENT DOCUMENTS

| | | |
|---|---|---|
| 3032503 | 5/1985 | Fed. Rep. of Germany . |
| 3522199 | 1/1987 | Fed. Rep. of Germany . |

*Primary Examiner*—Frankie L. Stinson

*Attorney, Agent, or Firm*—Sprung Horn Kramer & Woods

[57] ABSTRACT

A device for suctioning up and removing a contaminated liquid, especially dirty water, with a vacuumized tank having at the top at least one vacuum connection that communicates with a suction fan and a suction connection that communicates with a supply hose and at the bottom at least one outlet that can be closed off to prevent air from entering from outside. An outlet mechanism downstream of the outlet and controlled by the pressure of the air in the vacuumized tank keeps the liquid flowing out through the outlet even when there is a vacuum in the vacuumized tank at least for a prescribed length of time, during which it ensures that the outlet pressure represented by the sum of the liquid's hydrostatic pressure and the pressure of the air in the vacuumized tank is as high or higher than the counteracting air pressure downstream of the outlet.

13 Claims, 8 Drawing Sheets

DEVICE FOR SUCTIONING UP AND REMOVING A CONTAMINATED LIQUIDBACKGROUND OF THE INVENTION

The invention concerns a device for suctioning up and removing a contaminated liquid, especially dirty water, with a vacuumized tank having at the top at least one vacuum connection that communicates with a suction fan and a suction connection that communicates with a supply hose and at the bottom at least one outlet that can be closed off to prevent air from entering from outside. Devices of this kind are known and are described for example in German Patent 3 032 503 and German OS 3 522 199.

One drawback of the known device is that continuous operation is impossible while the fluid is being suctioned up because the vacuumized tank must be regularly emptied, at which time the suctioning must be discontinued because air must be admitted to the vacuumized tank to empty it.

SUMMARY OF THE INVENTION

The object of the invention is to improve a device of the aforesaid type to the extent that it is unnecessary to discontinue suctioning up the contaminated liquid when the vacuumized tank is full, which can be of great significance when suctioning up large volumes of liquid.

This object is attained in accordance with the invention by the improvement consisting of an outlet mechanism downstream of the outlet and controlled by the pressure of the air in the vacuumized tank that keeps the liquid flowing out through the outlet even when there is a vacuum in the vacuumized tank at least for a prescribed length of time, during which it ensures that the outlet pressure represented by the sum of the liquid's hydrostatic pressure and the pressure of the air in the vacuumized tank is as high or higher than the counteracting air pressure downstream of the outlet.

The basic concept behind the invention accordingly consists of avoiding the difficulty of emptying the vacuumized tank against the pressure of the air downstream of the outlet by equalizing the pressure upstream and downstream of the outlet from the vacuumized tank.

Two embodiments of the device in accordance with the invention that exploit the aforesaid basic concept while differing in principle are possible. In the first embodiment, the outlet mechanism comprises a column of liquid in a pipe downstream of the outlet that is high enough to ensure that the sum of the hydrostatic pressure it generates and the pressure of the air in the vacuumized tank is at least as high as the pressure of the outside air and there is a closure mechanism at the outer end of the pipe that opens in the direction of flow.

In this embodiment the difference between the pressure in the vacuumized tank and the pressure of the outside air is eliminated by an additional column of water with a hydrostatic pressure that precisely equals the difference in pressures. This embodiment allows, using only one tank, continuous operation while the liquid is being suctioned up and removed. The device, however, must be tall enough for the level of water in the column to be at least as high as necessary. Given the size of the suction fan and vacuumized spaces employed and the vacuum of 10 to 20 kPa accordingly generated in the vacuumized tank, the height of the water in the column must be approximately 1 to 2 m.

The closure mechanism can be a check valve, a downstream-oriented flap, or even a siphon.

In the second embodiment of the invention, the outlet mechanism has another vacuumized tank above or next to the first vacuumized tank and that communicates with the outlet of the first tank by way of a check valve or downstream-oriented flap and the two tanks communicate at the top through a bypass system that contains controls that can assume two different positions, connecting the inside of the first tank to the inside of the second tank when it is the first position and the inside of the second tank to the atmosphere when it is in the second position and shifted from one position to the other in accordance with the pressure of the air in the first tank and/or with the level of the liquid in one or both tanks, and the second tank has an outlet at the bottom that communicates with an outflow line by way of a check valve or downstream-oriented flap.

In the second embodiment, the pressures are equalized in that a second vacuumized tank is positioned downstream of the first vacuumized tank and in that a vacuum is established in the second tank long enough to allow the liquid to be removed from the tank itself, whereas the tank is at other times at atmospheric pressure, allowing the liquid to be removed from the second tank. The second tank accordingly acts more or less as a buffer for removing the dirty water from the first tank. The pressure in the second tank can be varied either in accordance with how full it is or, to particular advantage, in accordance with powerful fluctuations in pressure that occur inside the tank itself as the result of the suctioning technology. As will be described in greater detail hereinafter with reference to one embodiment, the contaminated liquid can be suctioned from an object by applying the end of the supply hose, with an intermediate suction adaptor if necessary, to the object. When the end of the hose or the adaptor is lifted from the object, the intake cross-section will be larger and more air will flow in. These variations in operation produce powerful fluctuations in pressure in the vacuumized area. The operation can be controlled to ensure that the auxiliary tank will be at atmospheric pressure while liquid is being supplied to the first tank and will empty as described hereinafter. When, for example, the adaptor is raised from the object, resulting in a such a powerful fluctuation in pressure that the vacuum in the tank becomes less powerful due to the entering air, the system will be diverted and the auxiliary tank will be subjected to the same vacuum suction as the first tank, allowing the liquid accumulated in the first tank to flow into the second tank during this phase of the operation. Once the adaptor has been applied to the object and more liquid is being suctioned in again, the system will be diverted back and the initial phase, during which the liquid suctioned off of the object is supplied to the first tank while the second tank is being emptied, returns.

The second embodiment can be controlled with a controllable three-to-two way valve.

This embodiment of the device in accordance with the invention also allows more or less continuous operation in that the mechanism that empties the vacuumized tank does not need to be turned off and the tank is emptied by way of the auxiliary tank during the naturally occurring phases of operation when there is less of a vacuum in the first tank.

BRIEF DESCRIPTION OF THE DRAWINGS

The two embodiments of the device in accordance with the invention will now be specified with reference to the drawings, wherein.

DETAILED DESCRIPTION OF THE INVENTION

Figure 1:
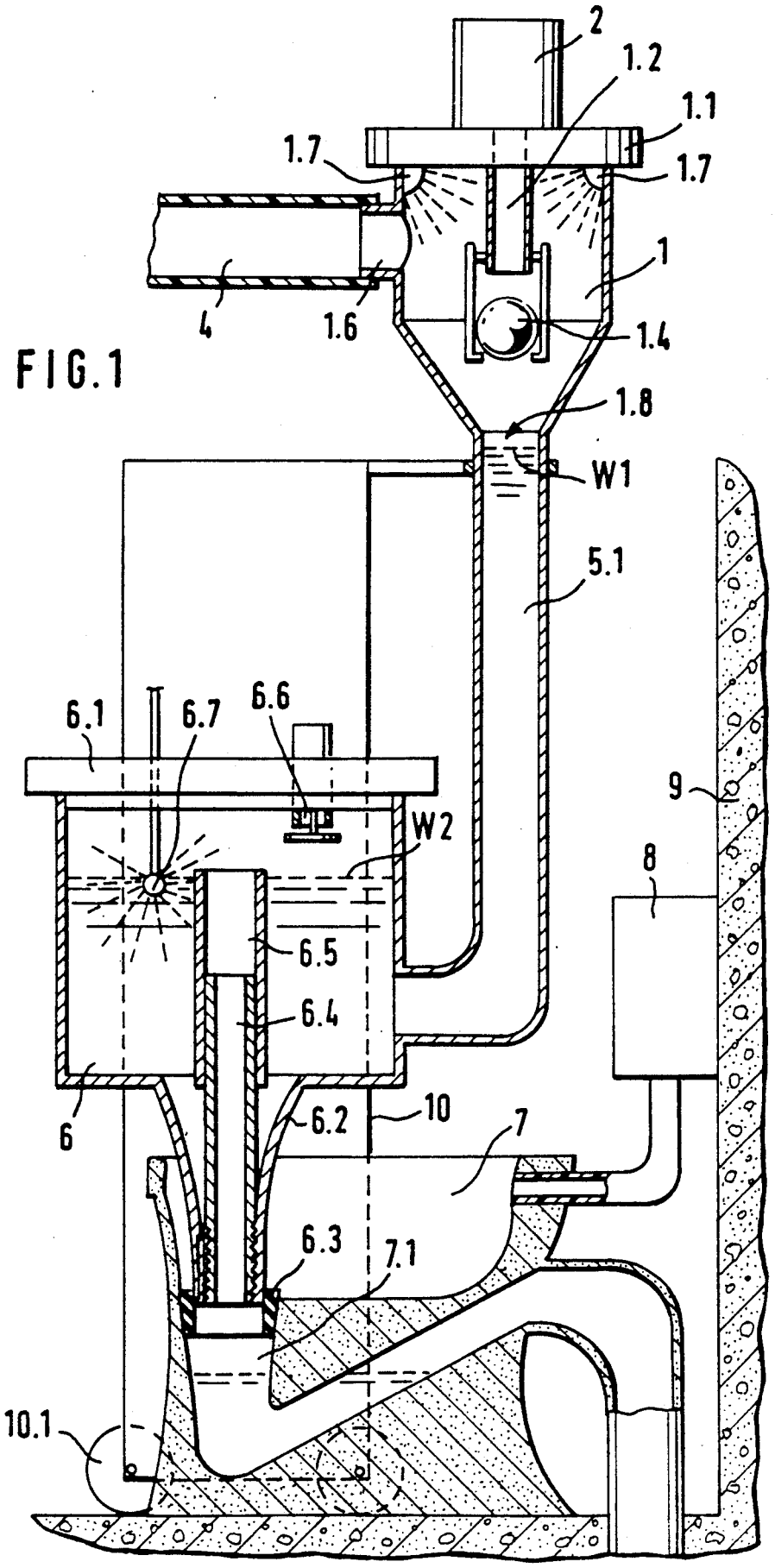
FIG. 1 is a highly schematic side view of a device for suctioning up dirty water that can be attached to a household toilet.
Figure 2:
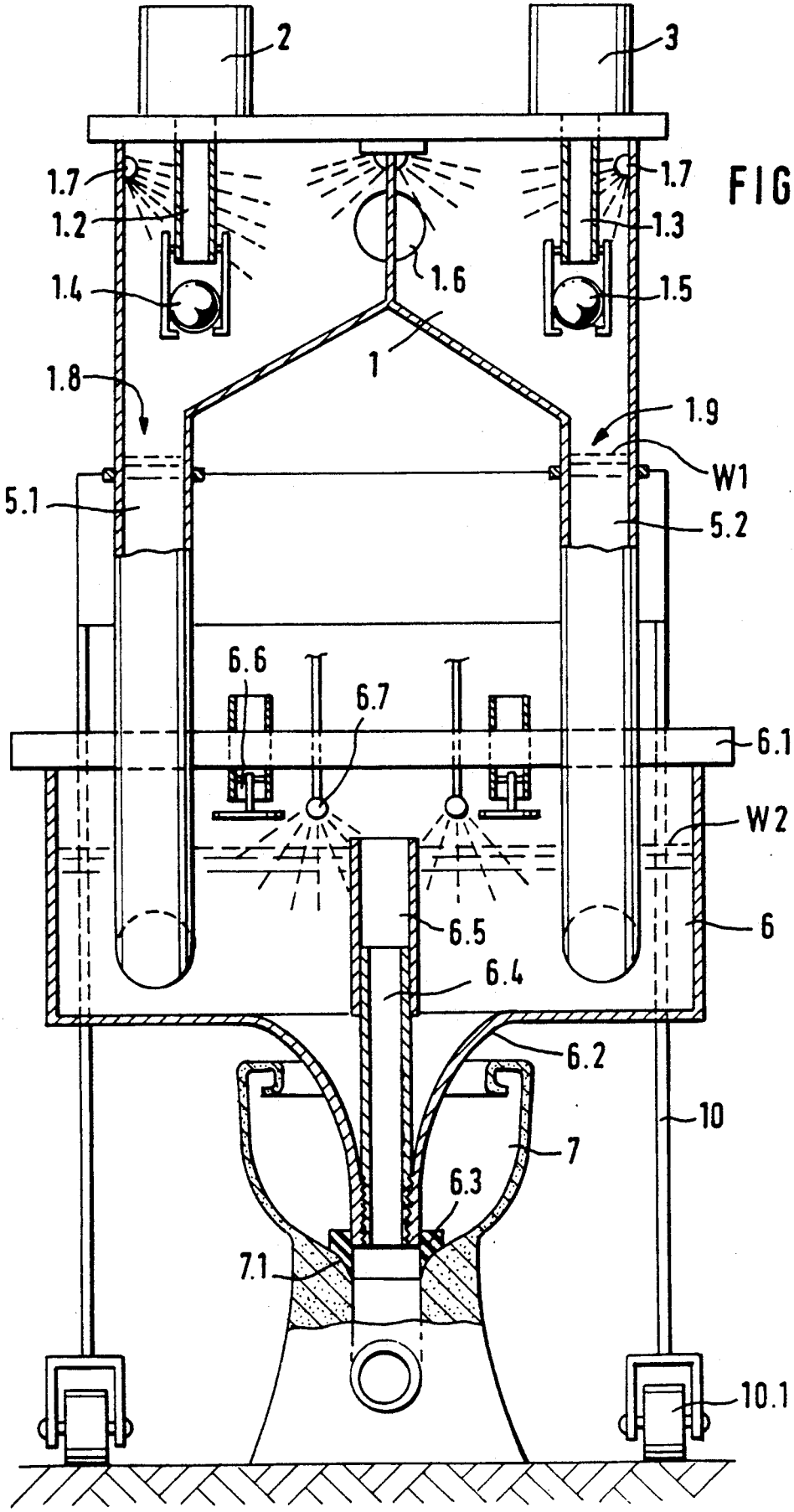
FIG. 2 is a similar rear view of the device illustrated in FIG. 1.

The device illustrated in FIGS. 1 and 2 is especially intended for suctioning up and removing contaminated liquid, dirty water for example, inside buildings—residences, offices, hospitals, etc. It is assumed that there is no functioning outlet, in the form of a toilet for example, any where in the vicinity.

The device has a base 10 mounted on wheels 10.1. Mounted on base 10 is a vacuumized tank 1 that is tightly closed at the top by means of a lid 1.1. Extending through the lid are two vacuum connections 1.2 and 1.3, each of which communicates with a suction fan 2 or 3 of known design mounted on lid 1.1. Positioned at the inner end of each vacuum connection 1.2 and 1.3 is a check valve 1.4 and 1.5 in the form of a ball valve, even when the water level inside the Vacuumized area rises rapidly.

Also opening into the top of vacuumized tank 1 is a suction connection 1.6, with which a supply hose 4 communicates. A suction tool of known design can be attached to the unillustrated free end of supply hose 4.

Also inside vacuumized tank 1 are nozzles 1.7, by way of which fresh water or another type of rinse can be supplied to clean out the inside of the tank.

Vacuumized tank 1 opens at the bottom into two outlets 1.8 and 1.9, each of which communicates with an upright water-column pipe 5.1 and 5.2. The bottom of pipes 5.1 and 5.2 extend into the bottom of a collector 6 that is also mounted on base 10. The top of collector 6 is closed off with a removable lid 6.1. At the bottom of collector 6 is a funnel-shaped outlet pipe 6.2 that extends into a bowl and has a sealing sleeve 6.3 on the outside. Screwed tightly into the funnel-shaped section of outlet pipe 6.2 is a water-removal pipe 6.4, the top of which extends into the collector. Telescoping from the top of the water-removal pipe is an inlet piece 6.5 that allows the inlet opening of the water-removal pipe to be adjusted to different levels inside collector 6. Also positioned in the lid 6.1 on collector 6 are two inwardly open check valves 6.6 that equalize the pressures and prevent air, sometimes charged with odorous materials, from leaving collector 6. Finally, collector 6 also accommodates nozzles 6.7, by way of which fresh water or another rinse can be supplied in a way that is not illustrated to clean out the collector.

In the illustrated example, the device is connected to a toilet that is being employed as an outlet for the dirty water. Base 10 is accordingly positioned above toilet bowl 7 with the outlet pipe 6.2 from collector 6 extending into the drain 7.1 in toilet bowl 7, with sealing sleeve 6.3 sealing the outlet off from the inlet opening in toilet bowl 7. To make it possible to advance base 10 to above the toilet on wheels 10.1, the part of the device that comprises collector 6 and vacuumized tank 1 can be raised and lowered on base 10 in an unillustrated way.

Also part of the overall toilet system is a conventional tank 8 mounted on a wall 9.

How the device illustrated in FIGS. 1 and 2 operates will now be described. Suction fans 2 and 3 are turned on, suctioning air from inside vacuumized tank 1. Enough water is then introduced into collector 6 for the vacuum generated in vacuumized tank 1 to raise the water in the two water-column pipes 5.1 and 5.2 to a level W1, at which the equilibrium to be specified hereinafter will prevail. The water is added to collector 6 in such a way that the water in collector 6 will rise to a level W2 above the connection to water-column pipes 5.1 and 5.2 and just below the intake into water-removal pipe 6.4.

Once an equilibrium is attained, the sum of the pressure prevailing in vacuumized tank 1 and the hydrostatic pressure of the column of water in pipes 5.1 and 5.2 between level W2 and level W1 will precisely equal the pressure of the outside air, with the bottom of water-column pipes 5.1 and 5.2 acting in conjunction with collector 6 in the capacity of a siphon.

The dirty water suctioned up through supply hose 4 as the result of the vacuum in vacuumized tank 1 when the suction tool is applied enters vacuumized tank 1, raising the water level therein. The water level in collector 6 will also rise in order to reestablish the equilibrium and, in the stationary state, precisely as much water will flow out of collector 6 through overflow 6.5 as is supplied to vacuumized tank 1. When the suction tool is lifted out of the volume of dirty water that is to be suctioned up, air will be able to flow back through supply hose 4, the pressure in the tank will rise, and the water will drop below level W1, although no farther than to level W2. When more dirty water is suctioned up again, the prior state of equilibrium will immediately become established with the water at level W1. The device can accordingly be operated continuously with the suctioned up dirty water being constantly pumped out into toilet bowl 7.

Figure 3:
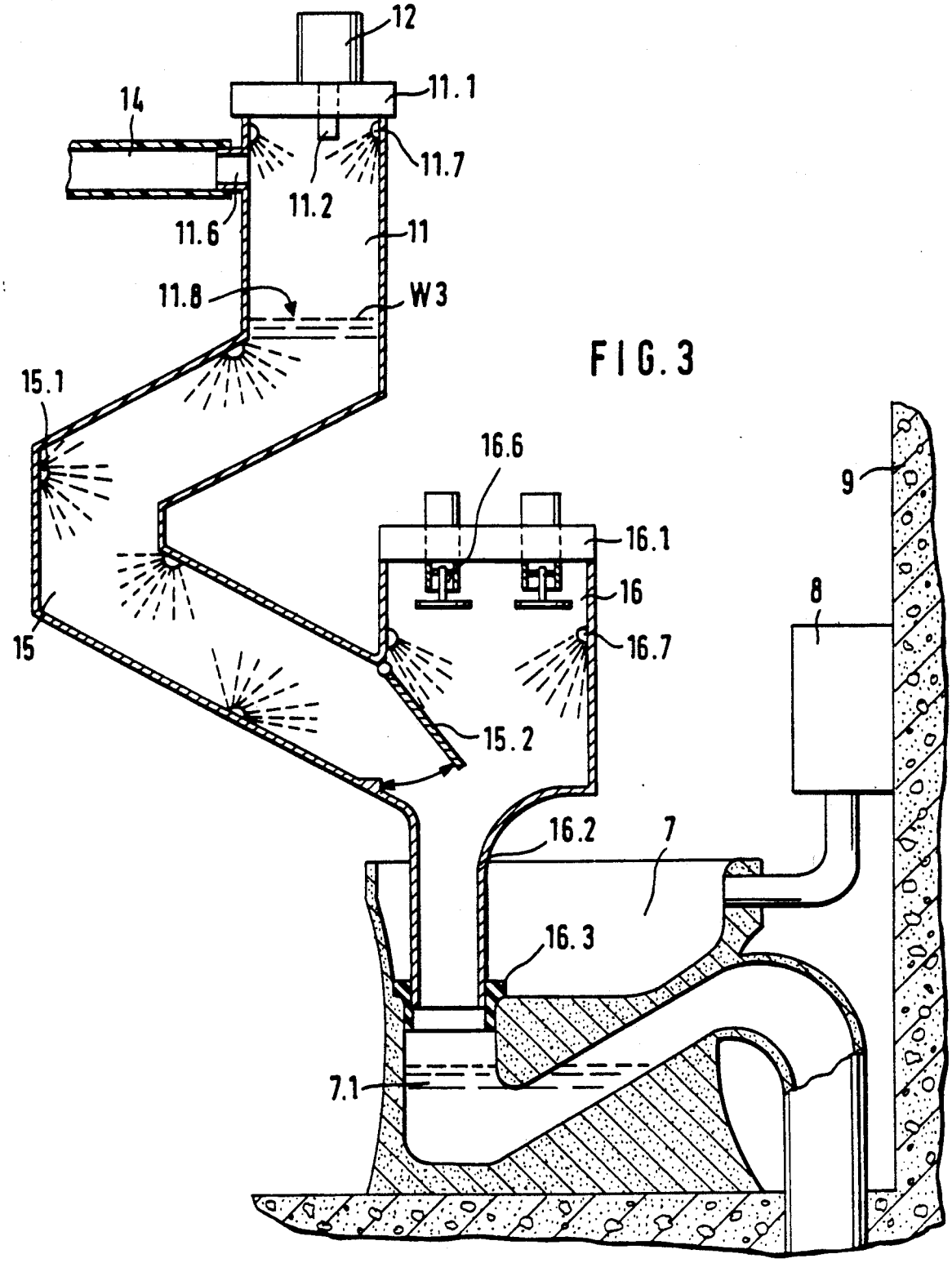
FIG. 3 illustrates a variant of the device illustrated in FIGS. 1 and 2.

FIG. 3 illustrates a variant of the embodiment illustrated in FIGS. 1 and 2.

A vacuumized tank 11 is closed of with a lid 11.1 that has a suction fan 12. The fan suctions air out of vacuumized tank 1 through a vacuum connection 11.2. Vacuumized tank 11 has a suction connection 11.6 that communicates with a supply hose 14. The outlet 11.8 from vacuumized tank 11 communicates with a collector 16 by way of a water-column pipe 15, whereby the inlet opening between water-column pipe 15 and collector 16 can be closed off with a downstream-oriented flap 15.2. Nozzles 11.7, 15.1, and 16.7 are accommodated in vacuumized tank 11, water-column pipe 15, and collector 16 respectively. Fresh water can be supplied through these nozzles to clean the components. The top of collector 16 is sealed off with a removable lid 16.1. The difference between the pressure in collector 16 and that of the atmosphere is eliminated by way of equalization valve 16.6.

The outlet pipe 16.2 from collector 16 is inserted into the outlet 7.1 of a toilet bowl 7 and sealed with a sleeve 16.3.

The device illustrated in FIG. 3 operates in principle like the device illustrated in FIGS. 1 and 2. The water in vacuumized tank 11 and in water-column pipe 15 is raised to a level W3 that will maintain the aforesaid equilibrium between atmospheric pressure and the sum of the pressure in vacuumized tank 11 and the hydrostatic pressure in water-column pipe 15. The pressure of the outside air maintains downstream-oriented flap 12.2 closed. As dirty water is supplied through supply hose 14 and the level of the water in vacuumized tank 11 rises, an equal volume of water leaves by way of collector 16, and the equilibrium will be reestablished.

The embodiments illustrated in FIGS. 1 through 3 must be at least high enough to accommodate water-column pipes 5.1, 5.2, and 15, which must be long enough to accommodate water columns that will generate enough hydrostatic pressure to match the prescribed vacuum in tanks 1 or 11.

Embodiments that do not have to satisfy this requirement and can accordingly be designed flatter will now be described.

Figure 4:
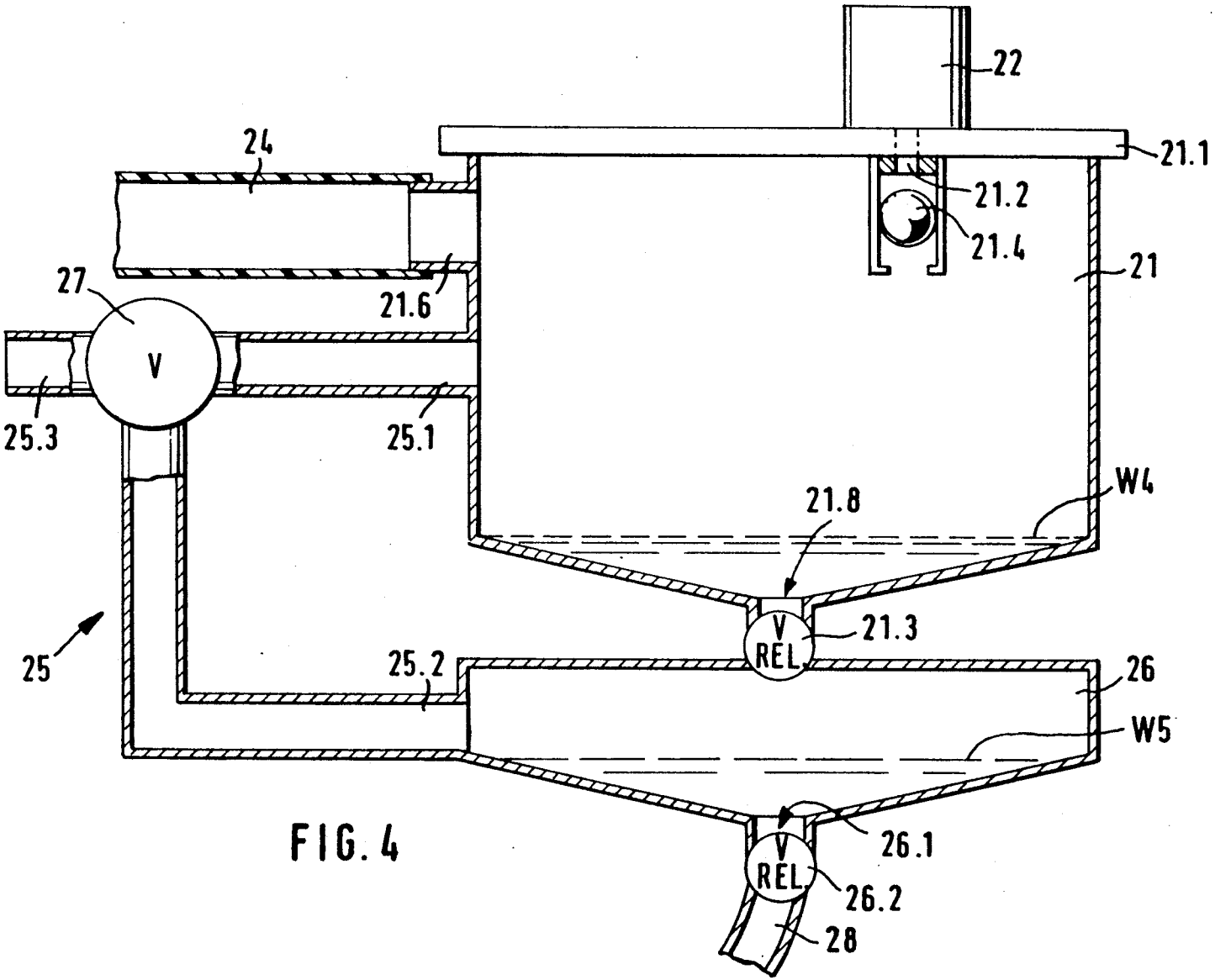
FIG. 4 is an also highly schematic illustration of a device for suctioning up dirty water with a series of two vacuumized tanks.

FIG. 4 illustrates a device for suctioning up and removing dirty water with a vacuumized tank 21 tightly closed at the top with a lid 21.1. Extending through the lid and inside vacuumized tank 21 is a vacuum connection 21.2 with a ball valve 21.4 on its free end. A suction fan 22 is mounted on lid 21.1 and communicates with the inside of vacuumized tank 21 by way of vacuum connection 21.2. Also opening into the top of vacuumized tank 21 is a suction connection 21.6 that communicates with a water-supply hose 24. An outlet 21.8 at the bottom of vacuumized tank 21 communicates by way of a check valve 21.3 with the top of another vacuumized tank 26 that has another outlet 26.1 communicating with a dirty-water removal line 28 by way of a check valve 26.2. The inside of first vacuumized tank 21 communicates by way of a bypass system 25 with the inside of second vacuumized tank 26. Bypass system 25 has a branch 25.2 that communicates with the inside of second vacuumized tank 26 and can be connected by way of a three-to-two way valve 27 either to a branch 25.3 that opens into the atmosphere or to a branch 25.1 that extends into first vacuumized tank 21.

Figure 5:
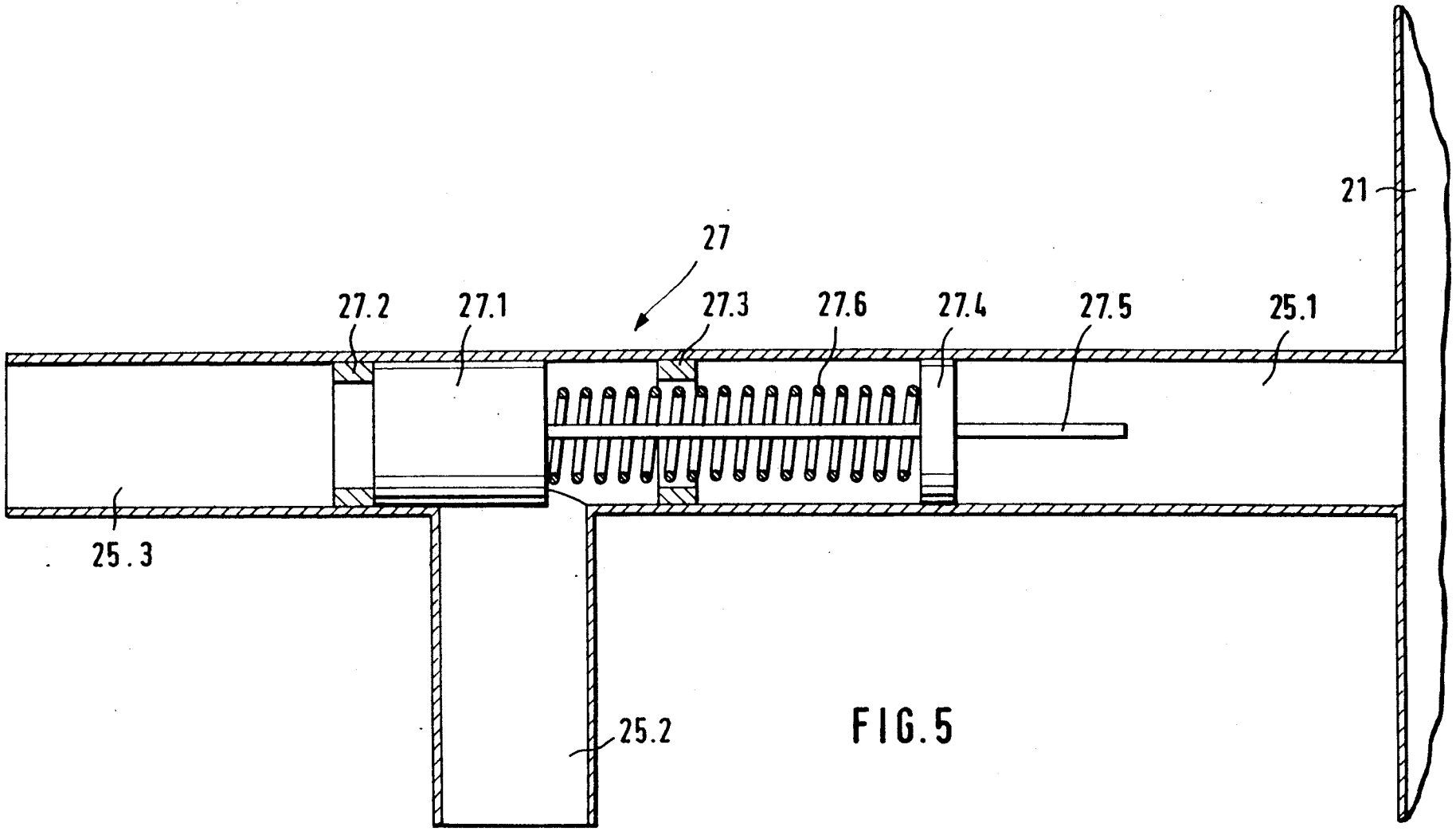
FIG. 5 is a detail of the embodiment illustrated in FIG. 4.

FIG. 5 illustrates one possible embodiment of three-to-two way valve 27 in greater detail. The mutually aligned branches 25.1 and 25.3 accommodate a piston-like valve plate 27.1 that slides back and forth between two valve seats 27.2 and 27.3. When valve plate 27.1 is in the position illustrated in FIG. 5, resting against valve seat 27.2, the branch 25.3 that opens into the atmosphere is closed and the two branches 25.1 and 25.2 are connected. Valve plate 27.1 can be displaced in conjunction with a tie rod 27.5 against the force of a compression spring 27.6. The end of the compression spring that faces away from valve plate 27.1 rests against a stop 27.4 that tie rod 27.5 slides back and forth through. The position of stop 27.4 can be adjusted in an unillustrated way to vary the stress on compression spring 27.6 and hence the response of the valve.

A powerful vacuum in branch 25.1 will force valve plate 27.1 to the right, out of the position illustrated in FIG. 5 and against valve seat 24.3, in which position branch 25.2 is connected to the branch 25.3 that opens to the atmosphere. If the vacuum in branch 25.1 weakens, compression spring 27.6 will force valve plate 27.1 back to the left and against stop 27.2, reestablishing the connection between branches 25.1 and 25.2.

How the device illustrated in FIGS. 4 and 5 operates will now be explained.

To suction up dirty water, suction fan 22 is turned on and the unillustrated suction tool at the free end of water-supply hose 24 is placed against the object that is to be cleaned. Suction fan 22 generates a powerful vacuum in vacuumized tank 21 that as previously described herein forces valve plate 27.1 against valve seat 27.3. In this position, the insides of vacuumized tanks 21 and 26 are separated and the inside of second vacuumized tank 26 is connected to the outer atmosphere by way of branches 25.2 and 25.3. The dirty water flows in subject to the vacuum in first vacuumized tank 21, where it can accumulate up to level W4. It is initially impossible for the liquid to flow out through outlet 21.8 because check valve 21.3 is kept closed by the pressure of the air in second vacuumized tank 26 and because the closure pressure cannot be overcome by the hydrostatic pressure of the column of water in first vacuumized tank 21 because of the vacuum prevailing at that point.

Any dirty water in second vacuumized tank 26 can, subject to these conditions however, flow directly out through outlet 26.1 and check valve 26.2.

If the suction tool is lifted while the device is in operation, allowing more air to flow into first vacuumized tank 21 through water-supply hose 24, the pressure in vacuumized tank 21 and accordingly in branch 25.1 will increase until valve 27 reverses and valve plate 27.1 returns to the position illustrated in FIG. 5, resting against valve seat 27.2. In this position, the insides of vacuumized tanks 21 and 26 are connected and the same pressure, which can be lower than that of the atmosphere, will prevail in each. In this position, the dirty water in first vacuumized tank 21 can flow into second vacuumized tank 26 by way of check valve 21.3, where it can accumulate up to level W5. It is impossible for the dirty water to flow out of second vacuumized tank 26 subject to these conditions because a certain amount of vacuum is prevalent in vacuumized tank 26 and check valve 26.2 is being kept closed by the pressure of the atmosphere.

If the suction tool is again applied to the object, the original state previously described herein will return and the dirty water will be suctioned into first vacuumized tank 21, out of which it cannot flow, and second vacuumized tank 26 will be able to empty itself by way of check valve 26.2.

The advantage of the device over known suction devices is that first vacuumized tank 21 never needs to be fully supplied with air during operation and that suction fan 22 can continue operating. Operation can be switched from the first to the second state strictly by lifting the suction tool, a procedure that will occur at any rate from time to time during the natural course of work. Level sensors that optionally emit alarm signals can of course be employed to ensure that neither vacuumized tank 21 or 26 fills beyond a prescribed level.

Figure 6:
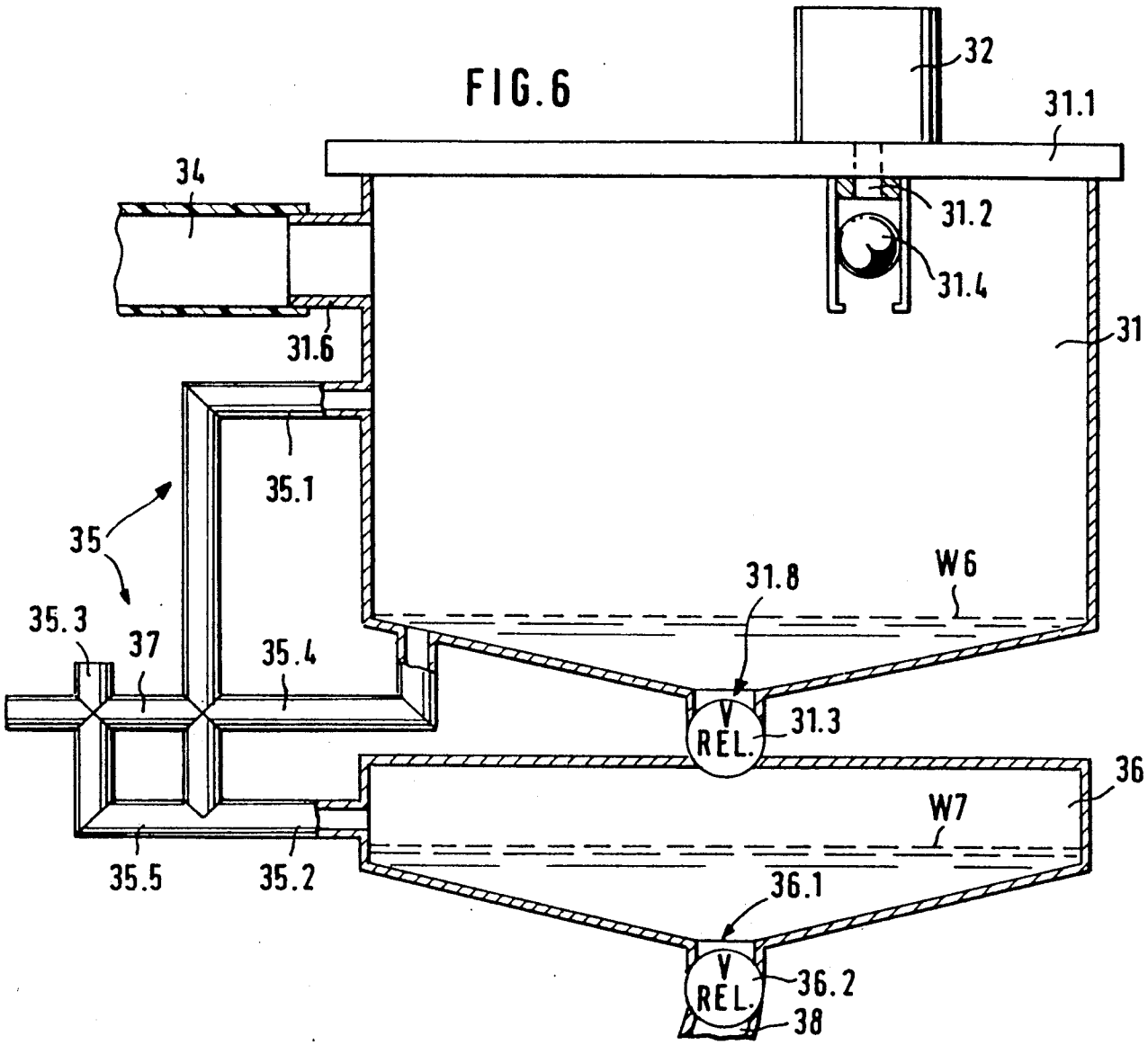
FIG. 6 illustrates another embodiment of a device for suctioning up dirty water with a series of two vacuumized tanks.
Figure 6A:
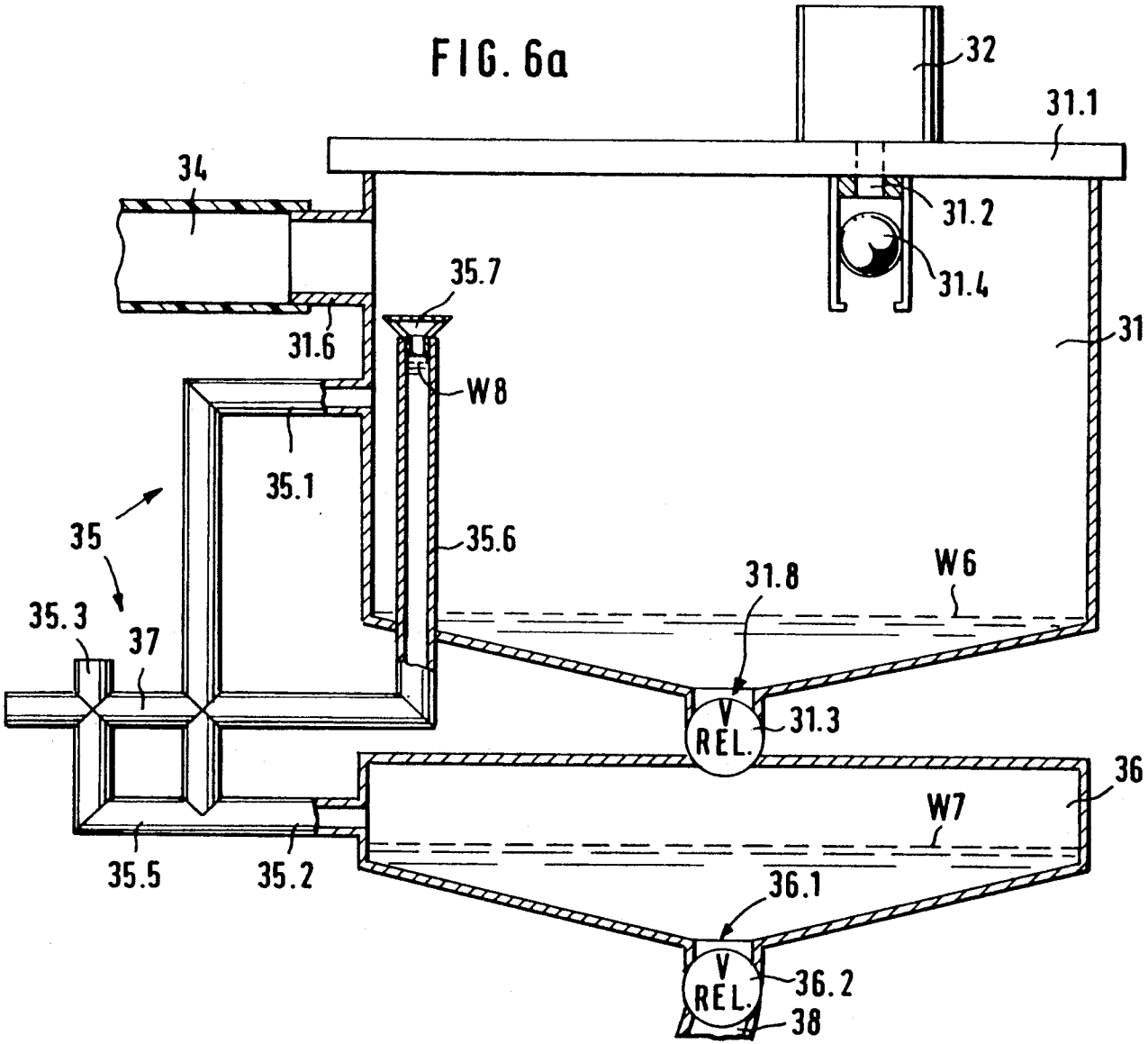
FIG. 6*a* illustrates a variant of the embodiment illustrated in FIG. 6.
Figure 7:
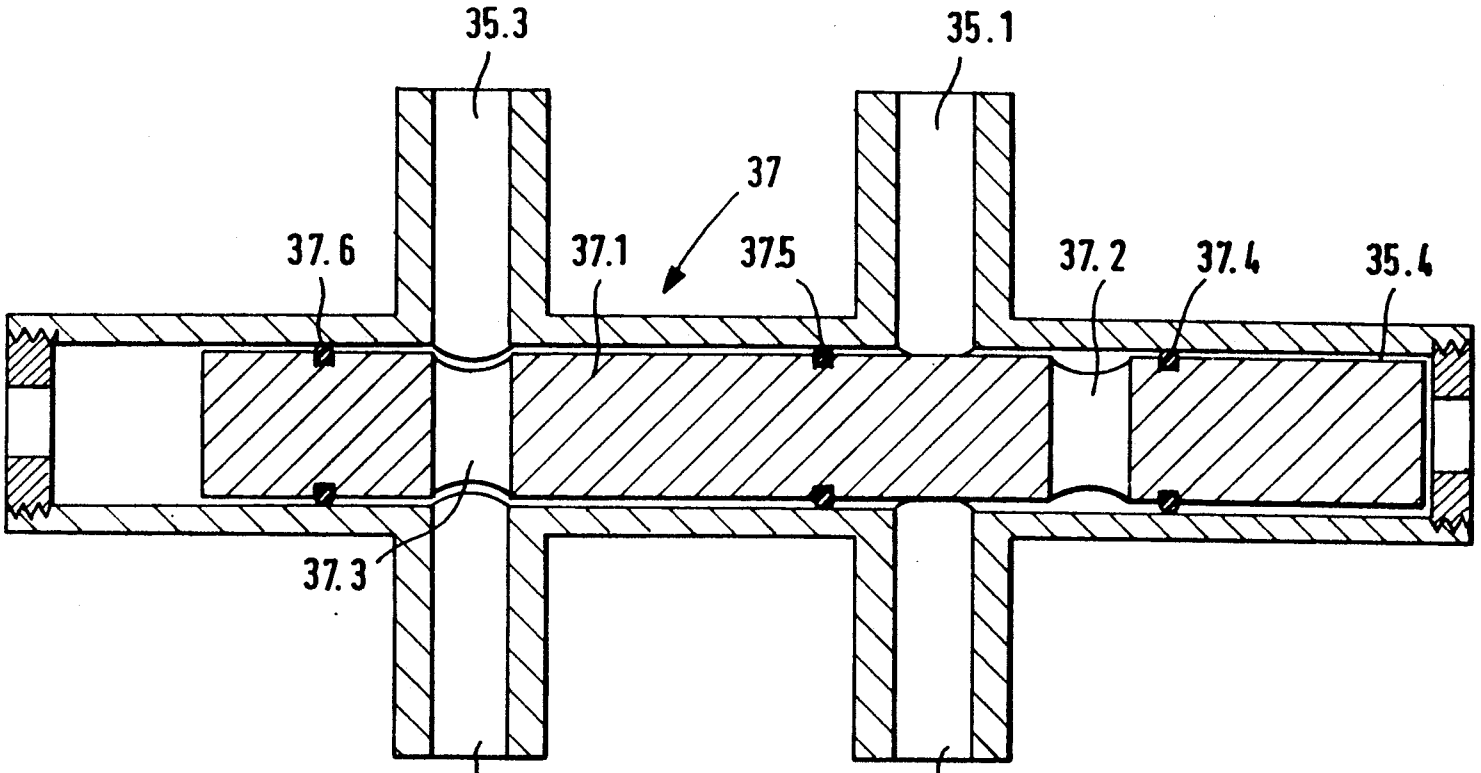
FIG. 7 is a detail of the embodiment illustrated in FIG. 6.

The device illustrated in FIGS. 6, 6*a*, and 7 differs from the device illustrated in FIGS. 4 and 5 essentially in the design of the bypass system and three-to-two way valve.

A suction fan 32 is mounted on the lid 31.1 of vacuumized tank 31 and evacuates the tank by way of a vacuum connection 31.2, which is provided with a ball valve 31.4. Communicating with the suction inlet 31.6 into vacuumized tank 31 is a water-supply hose 34. The outlet at the bottom of first vacuumized tank 31 communicates by way of a check valve 31.3 with the inside of another vacuumized tank 36, the outlet 36.1 of which communicates with a dirty-water removal line 38 by way of a check valve 36.2. The insides of vacuumized tanks 31 and 36 communicate by way of a bypass system 35 that contains a three-to-two way valve 37.

The bypass system in the variant illustrated in FIG. 6 comprises a total of four branches. First branch 35.1 communicates with the inside of the top of first vacuumized tank 31, second branch 35.2 with the inside of the top of second vacuumized tank 36, third branch 35.3 opens into the atmosphere, and fourth branch 35.4 communicates with the inside of the bottom of first vacuumized tank 31, which fills with accumulated dirty water during operation. FIG. 7 illustrates the three-to-two way valve in greater detail. A valve piston 37.1 slides back and forth in the straight section of fourth branch 35.4. The piston has two passages 37.3 and 37.3. Branches 35.1 and 35.2 can be connected through first passage 37.3 and branches 35.3 and 35.2 through passage 37.3 by way of a connecting branch 35.5. In the position illustrated in FIG. 7, first branch 35.1 is separated from second branch 35.2, which is connected by way of connecting branch 35.5 to third branch 35.3, which opens into the atmosphere. With valve piston 37.1 forced to the left on the other hand, first branch 35.1 is connected to second branch 35.2 and connecting branch 35.5 is separated from third branch 35.3. Valve piston 37.1 is sealed with rings 37.4, 37.5, and 37.6.

How the device illustrated in FIGS. 6 and 7 operates will now be described.

Once suction fan 32 is turned on and a tool attached to water-supply hose 34 has been applied to the object from which the dirty water is to be suctioned up, a powerful vacuum will become established in first vacuumized tank 31 and the pressure of the atmosphere will force valve piston 37.1 into the position illustrated in FIG. 7. The insides of vacuumized tanks 31 and 36 will be separated and the inside of second vacuumized tank 36 connected to the atmosphere by way of passage 37.3. The dirty water will flow into first vacuumized tank 31, in which it can accumulate approximately to level W6. Any dirty water in second vacuumized tank 36 can flow out through check valve 36.1. When the suction tool is lifted off the object and more air can flow through water-supply hose 34, the vacuum in first vacuumized tank 31 will become weaker. The hydrostatic pressure of the accumulating liquid will be sufficient, at least once a particular level of water has been attained, to force valve piston 37.1 to the left and into its other limiting position, in which first branch 35.1 is connected to second branch 35.2 and hence the inside of first vacuumized tank 31 to the inside of second vacuumized tank 36 and air will be unable to enter the second tank from the atmosphere. In this position, the dirty water will flow out of first vacuumized tank 31, through check valve 31.3, and into second vacuumized tank 36, wherein it can accumulate up to level W7. Once the suction tool has been applied again to the object from which the dirty water is being suctioned up, three-to-two way valve 37 will reverse and the original operating state will be reestablished.

The change from one state to the other in the embodiment illustrated in FIG. 6 also depends on how full first vacuumized tank 31 is. This is not, however, the case with the variant illustrated in FIG. 6*a*. In this variant, which is otherwise identical with the variant illustrated in FIG. 6, the fourth branch 35.4 of the bypass system does not communicate with the inside of first vacuumized tank 31 at the bottom but at the top, and fourth branch 35.4 communicates with a water-column pipe 35.6 that is filled with liquid, water for example, up to a level W8.

Three-to-two way valve 37 is similar to the valve illustrated in FIG. 7 and its response can be adjusted by the constant amount of liquid in water-column pipe 35.6. Valve piston 37.1 is forced to the left, out of the right-hand position illustrated in FIG. 7, when the sum of the hydrostatic pressure of the column of liquid in the pipe and the pressure still prevailing in first vacuumized tank 31 is sufficient to shift valve piston 37.1 against the pressure of the atmosphere. It is forced into the opposite position by the pressure of the atmosphere when the vacuum is powerful.

Preferably positioned above the column of liquid in water-column pipe 35.6 and resting on the surface of the liquid is a sealing piston 35.7 that slides up and down inside the pipe and prevents the liquid from leaking out when the pressure fluctuates extensively.

This embodiment as will can have level sensors and alarms for each vacuumized tank.

It is of course also possible to use other types of valve instead of the three-to-two way valve illustrated in FIGS. 5 and 7, especially electromagnetic valves controlled in an unillustrated way by sensors that respond to the pressure prevailing in first vacuumized tank 31 and optionally also to the levels of liquid in both tanks.

It is also possible to trip valves of this type at prescribed intervals of time, so that the tanks will empty at regular intervals.

It will be appreciated that the instant specifications and claims are set forth by way of illustration and not limitation, and that various modifications and changes may be made without departing from the spirit and scope of the present invention.

What is claimed is:

1. In a device for suctioning up and removing a contaminated liquid, especially dirty water, with a vacuumized tank having a top and a bottom, at least one vacuum connection at the top that communicates with a suction fan and a suction connection that communicates with a supply hose and at least one outlet at the bottom that can be closed off to prevent air from entering from outside, the improvement comprising: an outlet mechanism downstream of the outlet and controlled by the pressure of the air in the vacuumized tank that keeps the liquid flowing out through the outlet continuously even when there is a vacuum in the vacuumized tank, wherein the outlet mechanism comprises a column of liquid in a pipe downstream of the outlet that is high enough to ensure that the sum of the hydrostatic pressure it generates and the pressure of the air in the vacuumized tank is at least as high as the pressure of the outside air and a closure mechanism at an outer end of the pipe that opens in the direction of flow and wherein the closure member comprises a siphon.

2. The device as in claim 1, wherein the vacuumized tank is mounted on a base, on which a collector that is subject to the pressure of the atmosphere is mounted below the vacuumized tank with the pipe of the outlet mechanism opening into it, wherein the collector has a liquid outlet with an intake opening above the opening into the pipe and means for adding water to the collector during use to raise a level of the water in the collector to above the opening into the pipe and just below the intake opening of the liquid outlet.

3. The device as in claim 2, further comprising means for varying the height of the intake opening into the liquid outlet in the collector.

4. The device as in claim 2, wherein nozzles that can be supplied with a rinse are accommodated in the vacuumized tank and/or in the collector.

5. The device as in claim 2, wherein the collector is sealed off from the air with a removable lid that accommodates at least one pressure-equalizing valve that opens only into the collector.

6. The device as in claim 2, wherein the liquid outlet of the collector opens into an outlet connection on the bottom that can be introduced tight into the drain of a toilet bowl.

7. The device as in claim 2, wherein the base travels on wheels or rollers.

8. The device as in claim 1, wherein the outlet mechanism has another vacuumized tank above or next to the first vacuumized tank and that communicates with the outlet of the first tank by way of a check valve or downstream-oriented flap and the two tanks communicate at the top through a bypass system that contains controls that can assume two different positions, connecting the inside of the first tank to the inside of the second tank when it is the first position and the inside of the second tank to the atmosphere when it is in the second position and shifted from one position to the other in accordance with the pressure of the air in the first tank and/or with the level of the liquid in one or both tanks, and the second tank has an outlet at the bottom that communicates with an outflow line by way of a check valve or downstream-oriented flap.

9. The device as in claim 8, wherein the controls are governed such that they are in a second position when there is a prescribed powerful vacuum in the first vacuumized tank and in the first position when there is a prescribed weak vacuum.

10. The device as in claim 8, wherein the controls are a controllable three-to-two way valve.

11. The device as in claim 10, wherein the controls are an electromagnetically controlled three-to-two way valve, and sensors that detect the pressure of the air or the level of the liquid are accommodated in the vacuumized tanks with their output signals supplied to electronic controls that generate a signal that is supplied to the mechanism that activates the valve.

12. The device as in claim 10, wherein the three-to-two way valve can be directly controlled pneumatically by the pressure of the air in the first vacuumized tank.

13. The device as in claim 10, wherein the three-to-two way valve is controlled hydropneumatically by the sum of the pressure of the air in the first vacuumized tank and the hydrostatic pressure in a column of water.

* * * * *